US010874136B2

(12) United States Patent
Spektor

(10) Patent No.: US 10,874,136 B2
(45) Date of Patent: Dec. 29, 2020

(54) CIGAR AND CIGARETTE HOLDER

(71) Applicant: Yefim Spektor, Mason, OH (US)

(72) Inventor: Yefim Spektor, Mason, OH (US)

( * ) Notice: Subject to any disclaimer, the term of this patent is extended or adjusted under 35 U.S.C. 154(b) by 206 days.

(21) Appl. No.: 16/035,908

(22) Filed: Jul. 16, 2018

(65) Prior Publication Data

US 2020/0015517 A1 Jan. 16, 2020

(51) Int. Cl.
*A24F 13/08* (2006.01)
*A63B 57/20* (2015.01)

(52) U.S. Cl.
CPC ..... *A24F 13/08* (2013.01); *A63B 57/203* (2015.10)

(58) Field of Classification Search
CPC ..... A63B 57/20; A63B 57/203; A24F 47/008; A24F 47/012; A24F 47/022; A24F 13/08; A24F 13/22; A24F 15/08; B60N 3/12
USPC ..... 131/175, 178, 186, 187, 188, 190, 192, 131/260, 240.1
See application file for complete search history.

(56) References Cited

U.S. PATENT DOCUMENTS 2,580,985 A * 1/1952 Wooden ..... A63B 57/00 224/558
5,868,143 A * 2/1999 Nielsen ..... A24F 13/22 131/175
D408,097 S * 4/1999 Heydt ..... D27/183
D753,876 S * 4/2016 Parayo ..... A63B 57/00 D27/183
2011/0253154 A1* 10/2011 Dolciato ..... A24F 13/22 131/260
2017/0332698 A1* 11/2017 Cheung ..... A24F 13/08

OTHER PUBLICATIONS

Golf Galaxy."ProActive Sports Cigar Minder 4". Product Information. May 5, 2017. http://www.golfgalaxy.com/p/proactive-sports-cigar-minder-4-14proucgrmndracc/14proucgrmndracc (Year: 2017).*
https://web.archive.org/web/20110510024200/https://www.tclipgolf.com/, showing device publicly disclosed as early as May 10, 2011. Accessed on Jun. 10, 2019.
Dick's Sporting Goods "Cigar Minder 4" Product Information, Jun. 14, 2018, downloaded from https://www.dickssportinggoods.com/p/proactive-sports-cigar-minder-4-14proucgrmndracc/14proucgrmndracc, 1 page.

* cited by examiner

*Primary Examiner* — Joseph S Del Sole
*Assistant Examiner* — Margaret B Hayes
(74) *Attorney, Agent, or Firm* — Frost Brown Todd LLC

(57) ABSTRACT

A device for holding a cylindrical element includes a base and a clamp arm coupled with the base. The clamp arm is configured to pivot relative to the base between an open position and a closed position for clamping a cylindrical element against the base, and the clamp arm is resiliently biased toward the closed position. A support feature coupled with the base is configured to support an elongate element while the clamp arm clamps the cylindrical element. The device further includes a stem extending away from the base.

20 Claims, 5 Drawing Sheets

CIGAR AND CIGARETTE HOLDER

BACKGROUND

Consumable tobacco products, such as cigars and cigarettes, are often enjoyed by users while engaging in various activities, such as golf and other sporting or recreational activities of the like. Various devices have been made and used for temporarily holding such tobacco products to enable a user to engage in such activities without having to hold the product during the activity. However, it is believed that no one prior to the inventor has made or used the invention described in the appended claims.

BRIEF DESCRIPTION OF THE DRAWINGS

The accompanying drawings, which are incorporated in and constitute a part of this specification, illustrate embodiments of the invention, and, together with the general description of the invention given above, and the detailed description of the embodiments given below, serve to explain the principles of the present invention.

Figure 1:
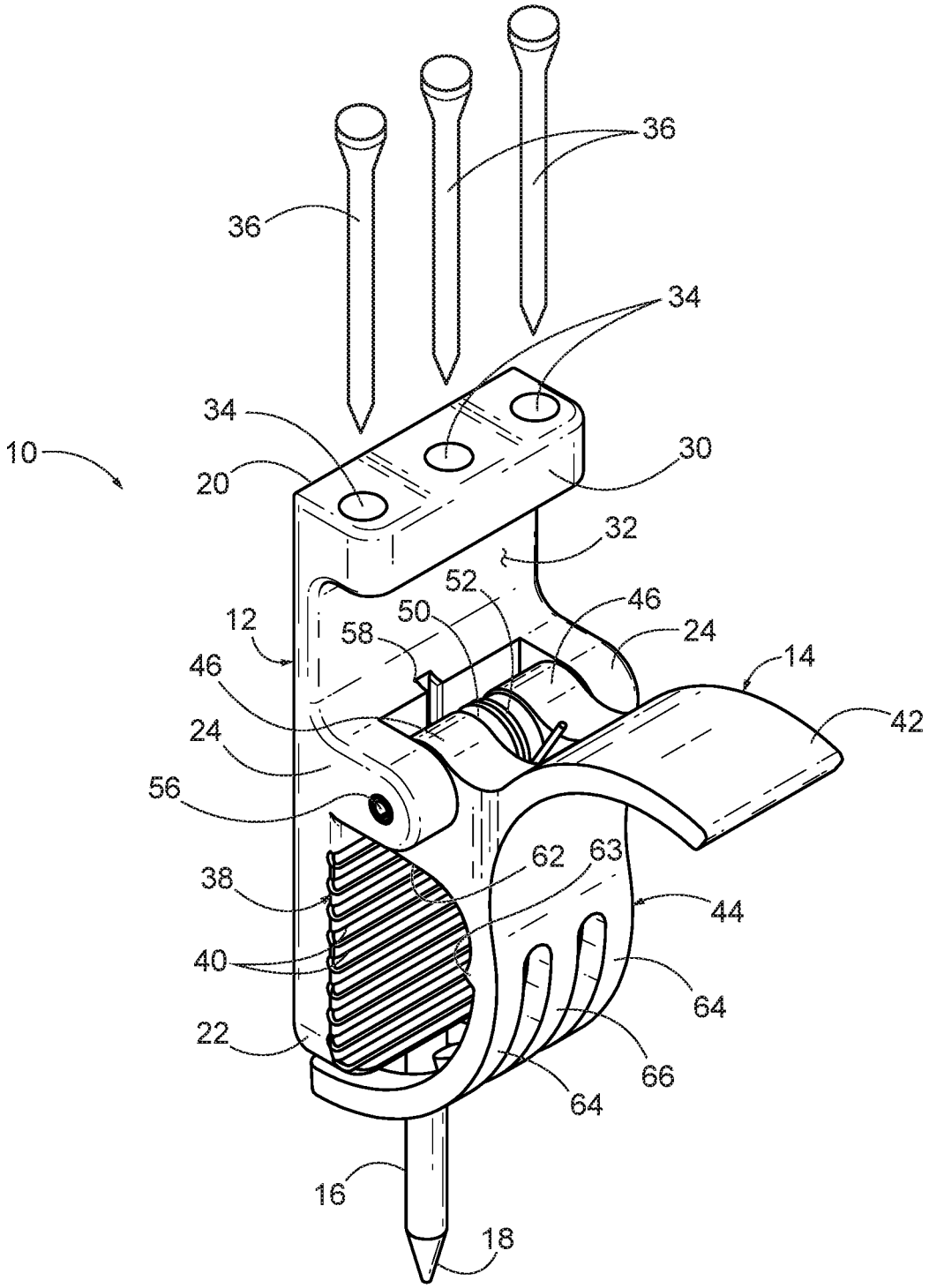
FIG. 1 depicts a front perspective view of an exemplary device for holding a cylindrical element such as a tobacco product, showing a clamp arm of the device in a fully closed position relative to a base of the device.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

To the extent that spatial terms such as "upper," "lower," "vertical," "horizontal," or the like are used herein with reference to the drawings, it will be appreciated that such terms are used for exemplary description purposes only and are not intended to be limiting or absolute. In that regard, it will be understood that devices such as those disclosed herein may be used in a variety of orientations and positions not limited to those shown and described herein. Further, the terms "about" and "approximately" as used herein for any numerical values or ranges indicate a suitable dimensional tolerance that allows the part or collection of components to function for its intended purpose as described herein.

I. Exemplary Device for Holding Cylindrical Tobacco Products

Figure 2:
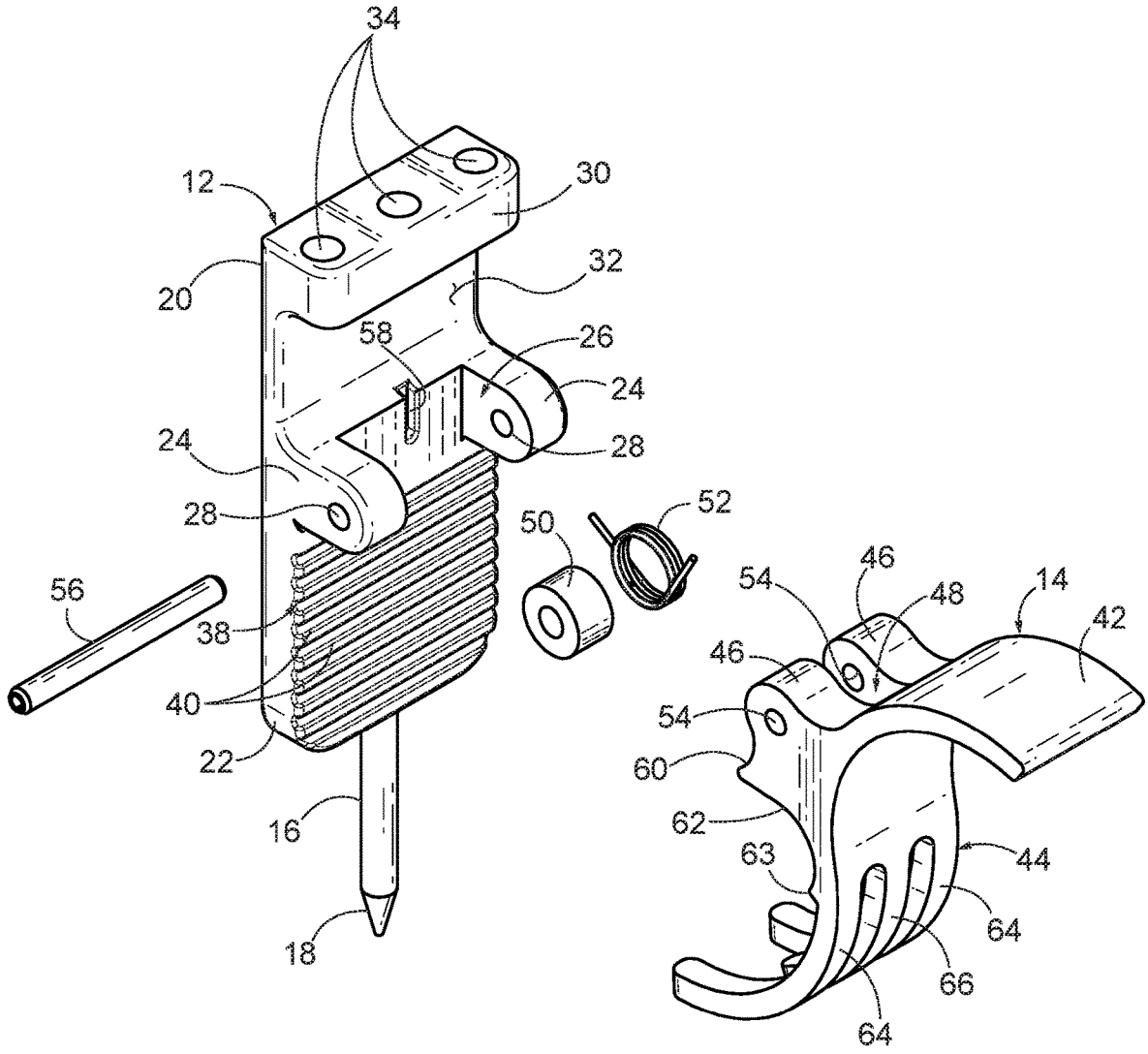
FIG. 2 depicts a disassembled perspective view of the device of FIG. 1.

FIGS. 1-2 show an exemplary device (10) for holding a cylindrical element, such as a cigar, cigarette, or other type of generally cylindrical tobacco product, for example. Device (10) generally includes a base (12), a clamp arm (14) pivotably coupled with base (12), and an elongate stem (16) extending away from base (12). As described in greater detail below, clamp arm (14) is operable to clamp cylindrical elements of various diameters against base (12), for instance to enable a user to engage in an activity without having to personally hold the cylindrical element during the activity. As also described below, device (10) of the present example includes features that render device (10) particularly useful during golfing activities. However, it will be appreciated that device (10) may be used in various other applications as well.

As seen best in FIG. 2, base (12) of the present example is formed as a generally rigid, monolithic structure having an upper base end (20) and a lower base end (22) that are opposed from one another along a longitudinal axis of base (12). It will be appreciated that in other examples one or more portions of base (12) may be formed separately and secured together to define the structure shown. A medial portion of base (12) arranged between upper and lower base ends (20, 22) provides a pair of pivot supports (24) that project outwardly from base (12). Pivot supports (24) are spaced apart from one another laterally to define a gap (26) sized to receive a portion of clamp arm (14) therebetween in pivoting engagement, as described in greater detail below. Pivot supports (24) includes through holes (28) extending laterally therethrough, which are configured to receive a pivot pin (56), as described below.

Upper base end (20) of device (10) defines a support feature in the form of a shelf (30) that is rigidly coupled with the medial portion of base (12) and is spaced longitudinally from pivot supports (24). Shelf (30) of the present example extends laterally across a full width of base (12) and projects outwardly toward an upper end of clamp arm (14) so as to overhang a recessed surface (32) that extends between upper base end (20) and pivot supports (24). An upper surface of shelf (30) includes a plurality of openings in the form of through holes (34) that extend parallel to a longitudinal axis of base (12). Each through hole (34) is suitably sized to receive and releasably retain, via frictional engagement, a respective elongate element in the form of a golf tee (36). As shown best by FIGS. 1 and 3A-3D in combination, through holes (34) (see FIG. 1) support tees (36) such that tees (36) extends generally parallel to the longitudinal axis. In some versions, each through hole (34) may be formed with the same diameter, while in other versions through holes (34)

may be formed with different diameters. In the present example, each through hole is formed with a diameter of approximately 0.19 inches.

Shelf (30) is spaced longitudinally from pivot supports (24) by a distance suitable to accommodate the shafts of tees (36) in the space overlying recessed surface (32), such that the distal tips of tees (36) do not interfere with actuation of clamp arm (14) relative to base (12). While device (10) is shown having three through holes (34) arranged linearly across the width of shelf (30), various alternative quantities and arrangements of through holes (34) may be provided. For instance, shelf (30) may include four or more through holes (34). In some versions, shelf (30) may be alternatively configured with through holes and/or various other features suitably configured to support one or more golf tees (36) such that tees (36) extend transversely to the longitudinal axis of device (10). Further, it will be appreciated that device (10) may include various types, quantities, and arrangements of features other than through holes (34) suitable to releasably retain one or more golf tees (36) of various lengths and diameters. Such features may be rigid, flexible, or adjustable, for example.

As seen best in FIG. 2, base (12) further includes a retaining surface (38) that extends longitudinally from pivot supports (24) to lower base end (22). Retaining surface (38) is configured to retain a cylindrical element, such as a cigar or cigarette, being clamped by clamp arm (14). Retaining surface (38) of the present example includes texturing in the form of laterally extending ribs (40) configured to promote frictional engagement between retaining surface (38) and the cylindrical element to provide secure clamping. In other examples, texturing on retaining surface (38) may be provided in various other forms suitable to promote such frictional engagement.

Elongate stem (16) is coupled to lower base end (22) and extends away from base (12) along the longitudinal axis thereof. Stem (16) is configured to be inserted into a support structure and thereby securely anchor device (10) to the support structure during use. For instance, in an exemplary application, stem (16) may be driven into an outside ground surface such that the longitudinal axis of device (10) extends generally vertically. In other exemplary applications, stem (16) may be driven or otherwise inserted into the side of a support structure such that the longitudinal axis of device (10) extends generally horizontally or in various orientations between horizontal and vertical. In the present example, stem (16) includes a pointed tip (18) configured to facilitate insertion of the distal end of stem (16) into a support structure.

Stem (16) of the present example is sized and shaped similar to the shaft portion of a golf tee, such as tees (36) described above, such that stem (16) may be conveniently received by various golf tee support structures provided at golfing facilities. Such golf tee support structures may include golf tee holes provided in the dashboards of golf carts (not shown), for example. In some versions, stem (16) may be formed with a length of approximately 1.25 inches and a diameter of approximately 0.16 inches. Additionally, base (12), clamp arm (14), and stem (16) may be suitably sized to provide device (10) with a compact structure that is easily transported by a user within his or her pocket when device (10) is not actively being used to hold a cylindrical element, as described below. For instance, in some versions base (12) may be formed with a lateral width of approximately 1.25 inches, and base (12) and stem (16) may provide device (10) with a total length of approximately 4 inches.

As shown best in FIGS. 1 and 2, clamp arm (14) of the present example is formed as an arcuate, monolithic structure having an actuation tab (42) and a clamping hand (44) extending downwardly therefrom. Clamp arm (14) and base (12) may each be formed of a variety of suitable materials that will be readily apparent to those of ordinary skill in the art in view of the teachings herein. In some versions, clamp arm (14) and base (12) may be formed in whole or in part of one or more light-weight materials such as various plastics or metals. Further, clamp arm (14) and base (12) may be formed of the same or different materials.

Actuation tab (42) of clamp arm (14) curves in a first direction away from base (12) to define a concave portion of clamp arm (14), and clamping hand (44) curves in an opposite direction toward base (12) to define a convex portion of clamp arm (14). A pair of pivot projections (46) are disposed on an inner side of clamp arm (14) at the junction of actuation tab (42) with clamping hand (44) and extend inwardly toward base (12). Pivot projections (46) are spaced apart laterally to define a gap (48) therebetween sized to receive a bushing (50) and a torsion spring (52). Pivot projections (46) define an outer lateral width of clamp arm (14) suitable to enable pivot projections (46) to be received within gap (26) defined between pivot supports (24). Laterally extending through holes (54) of pivot projections (46) are configured to align with through holes (28) of pivot supports (24), bushing (50), and torsion spring (52) to receive pivot pin (56) therethrough and thereby define a pivot hinge assembly. Pivot pin (56) may be in the form of a spring pin configured to resiliently retain itself in place within base (12) while permitting clamp arm (14) to pivot relative to base (12) about pin (56).

As seen in FIGS. 1 and 3A-4, when clamp arm (14) is assembled with base (12) in the manner described above, actuation tab (42) overlies the upper portion of base (12), including shelf (30), and clamping hand (44) overlies the lower portion of base (12), including retaining surface (38). Clamp arm (14) is configured to pivot relative to base (12) from a closed position to an open position in response to actuation tab (42) being depressed toward upper base end (20) by a user. Torsion spring (52) is configured to resiliently bias clamp arm (14) toward the closed position. In particular, a first leg of torsion spring (52) is configured to resiliently engage an underside of clamp arm (14) between pivot projections (46). A second leg of torsion spring (52) is configured to be received within, and resiliently engage an inner wall of, a longitudinal recess (58) formed in the medial portion of base (12) between pivot supports (24). It will be appreciated that torsion spring (52) may be replaced with one or more other types of resilient members in other examples, such as leaf springs, coil springs, or the like.

Clamp arm (14) includes a combination of features that enable clamping of cylindrical elements of various diameters between clamping hand (44) and retaining surface (38) of base (12). As described in greater detail below, clamping hand (44) of the present example includes three distinct clamping portions, each of which is configured to independently clamp a cylindrical element of a respective diameter range. Moreover, clamping hand (44) is configured such that two or more of the clamping portions may clamp respective cylindrical elements simultaneously, for example as shown in FIG. 3D.

Figure 3A:
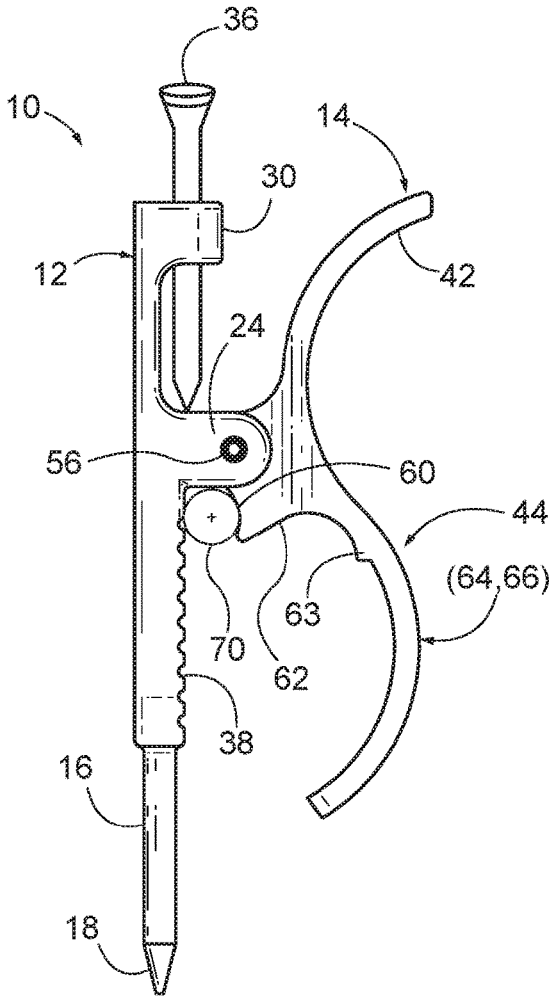
FIG. 3A depicts a side elevation view of the device of FIG. 1, showing the clamp arm in an exemplary first pivot position for clamping a cylindrical element of an exemplary first diameter against the base.
Figure 3B:
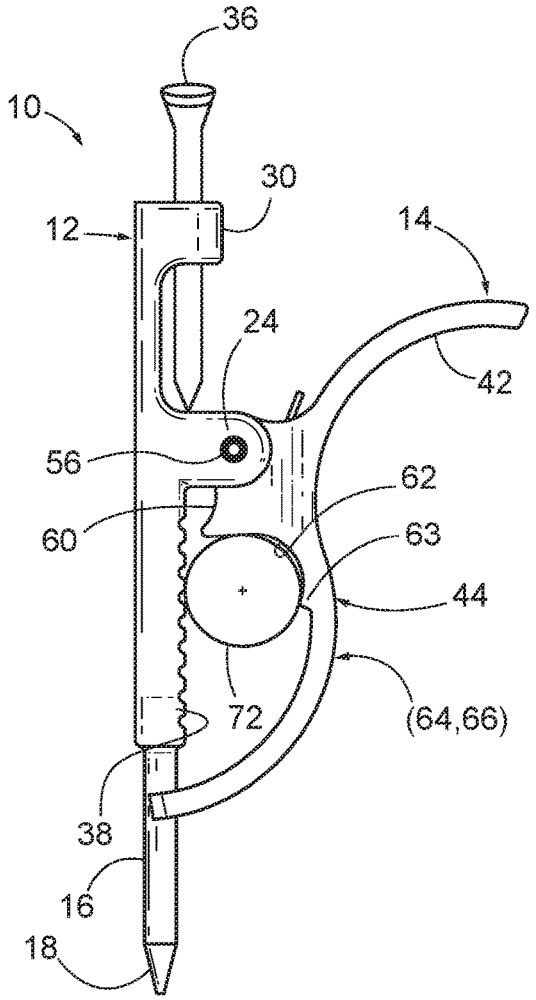
FIG. 3B depicts a side elevation view of the device of FIG. 1, showing the clamp arm in an exemplary second pivot position for clamping a cylindrical element of an exemplary second diameter against the base.
Figure 3C:
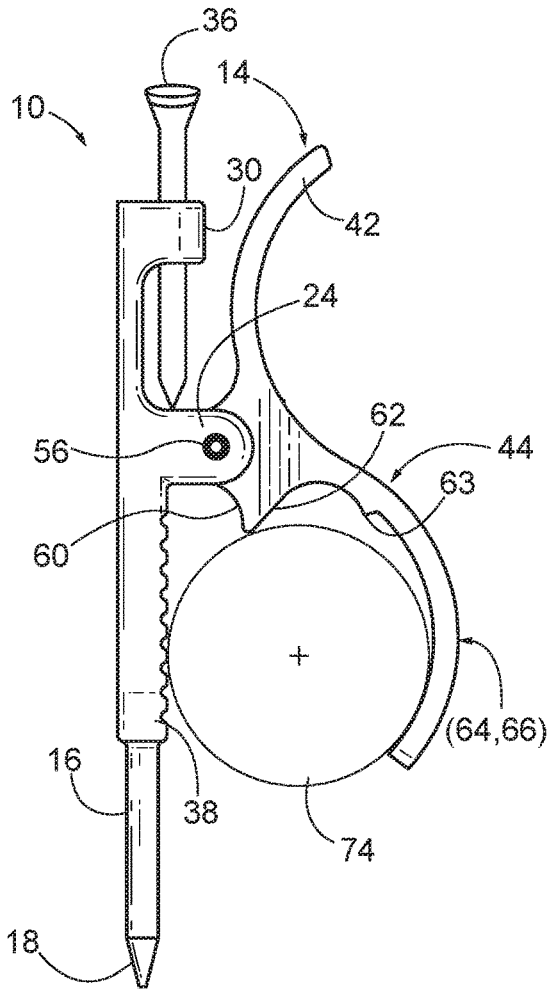
FIG. 3C depicts a side elevation view of the device of FIG. 1, showing the clamp arm in an exemplary third pivot position for clamping a cylindrical element of an exemplary third diameter against the base.
Figure 3D:
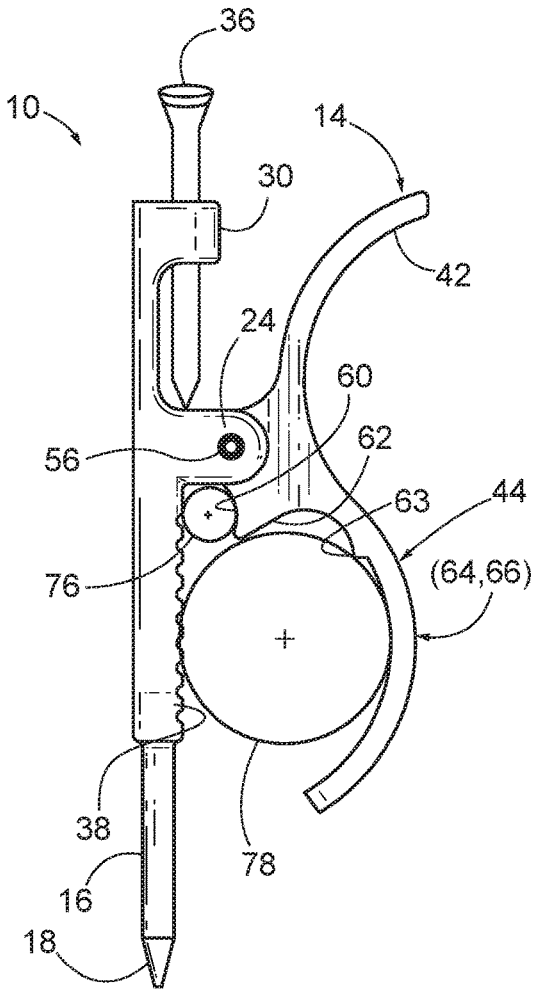
FIG. 3D depicts a side elevation view of the device of FIG. 1, showing the clamp arm in an exemplary pivot position for clamping first and second cylindrical elements of different diameters simultaneously against the base.
Figure 4:
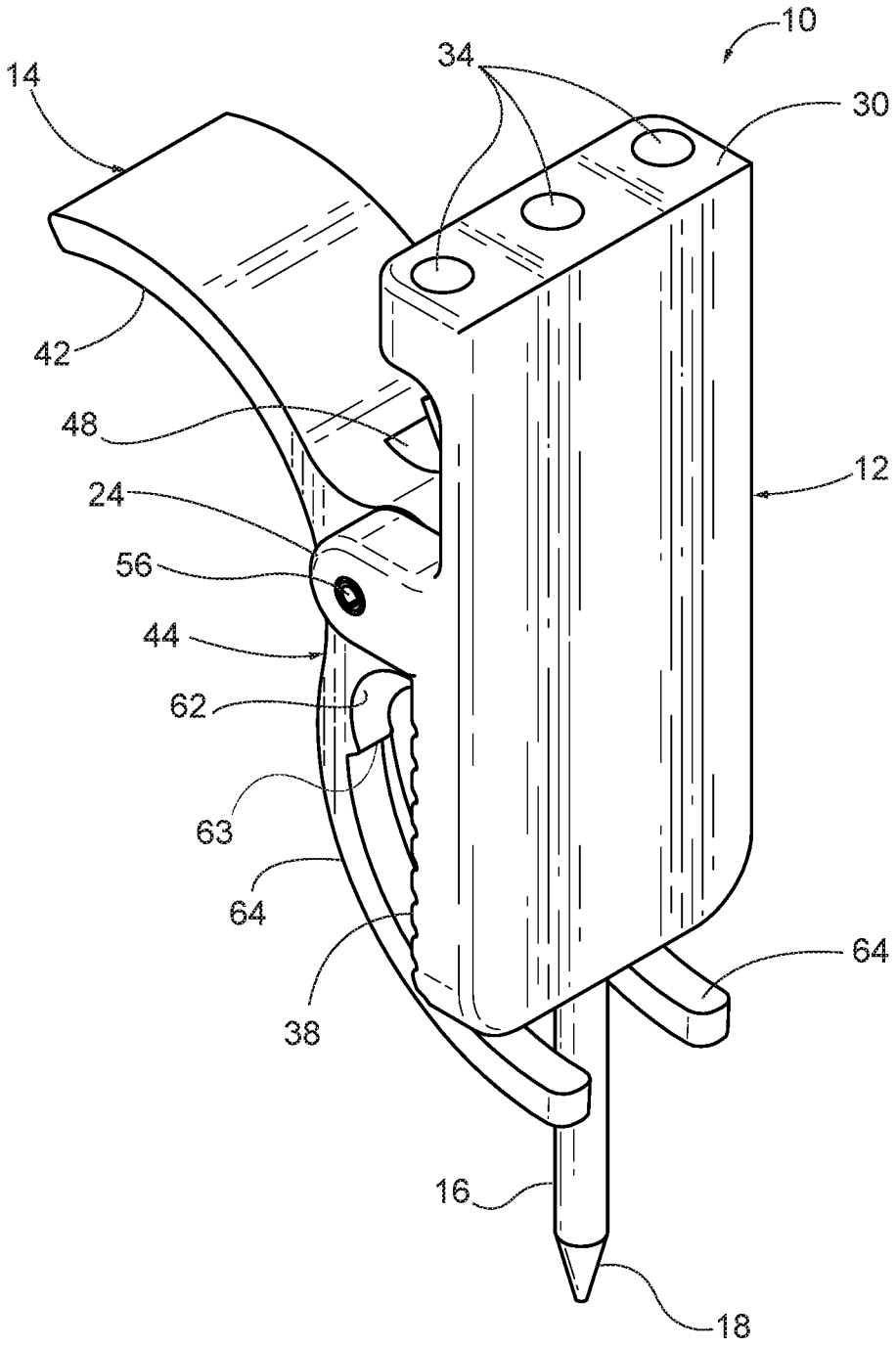
FIG. 4 depicts a rear perspective view of the device of FIG. 1, showing additional features of a clamping side of the clamp arm.

As seen best in FIGS. 2 and 3A, a first clamping portion of clamping hand (44) is defined by a pair of knuckles (60) projecting from an underside of clamp arm (14). Each knuckle (60) of the present example extends directly from a respective pivot projection (46) in a direction toward lower base end (22) and terminates at a lower tip. Knuckles (60) include respective concave clamping surfaces that face retaining surface (38) and cooperate to clamp cylindrical elements of relatively smaller outer diameters, such as a cigarette or small cigar (70, 76) as shown in FIGS. 3A and 3D.

A second clamping portion of clamping hand (44) is defined by a pair of intermediate concave surfaces (62), each of which extends distally from a respective knuckle (60) in a direction toward lower base end (22) and terminates with a step-like projection (63). Intermediate clamping surfaces (62) face retaining surface (38) and are configured to cooperate to clamp cylindrical elements of intermediate outer diameters, such as a medium size cigar (72).

A third clamping portion of clamping hand (44) is defined by a plurality of elongate arcuate fingers (64, 66) that extend distally from knuckles (60) toward lower base end (22). As shown best in FIGS. 1 and 2, clamping hand (44) of the present example includes two side fingers (64) and a shortened middle finger (66), which define respective concave clamping surfaces that face retaining surface (38) and cooperate to clamp cylindrical elements of relatively larger outer diameters, such as larger cigars (74, 78), independently of knuckles (60) and intermediate concave clamping surfaces (62). In other versions, one or more of the clamping portions (60, 62, 64, 66) of clamping hand (44) may be provided with alternatively shaped clamping surfaces, such as clamping surfaces having planar and/or convex portions, for example. In some examples, each finger (64, 66) may be configured to resiliently flex transversely and/or laterally relative to knuckles (60). Each finger (64, 66) includes a free terminal end that confronts lower base end (22) when clamp arm (14) is in a fully closed position, as shown in FIG. 1. In particular, the free ends of side fingers (64) sit along either side of a proximal end of stem (16), and the free end of middle finger (66) overlies the proximal end of stem (16).

FIGS. 3A-3D show clamp arm (14) in a plurality of exemplary pivot positions relative to base (12) for clamping a corresponding plurality of exemplary cylindrical elements (70, 72, 74, 76, 78) of varying diameters. Because clamping portions (60, 62, 64, 66) described above are integrally coupled components of clamp arm (14) in the present example, pivoting clamp arm (14) from a closed position (see, e.g., FIG. 1) to an open position of any degree operates to move clamping portions (60, 62, 64, 66) away from retaining surface (38) simultaneously. However, because knuckles (60) are longitudinally closer to the clamp arm pivot axis defined by pivot pin (56) than are intermediate clamping surfaces (62) and fingers (64, 66), and are transversely closer to retaining surface (38) than are intermediate clamping surfaces (62) and fingers (64, 66), intermediate clamping surfaces (62) and fingers (64, 66) are configured to receive and clamp cylindrical elements of a greater maximum outer diameter than knuckles (60). Furthermore, as seen in FIGS. 3A-3D, the clamping surfaces of fingers (64, 66) have a larger radius of curvature than intermediate clamping surfaces (62), such that fingers (64. 66) are configured to receive and clamp cylindrical elements of a greater maximum outer diameter than intermediate clamping surfaces (62).

In that regard, when clamp arm (14) is pivoted to a given open position relative to base (12), knuckles (60) define a first maximum gap distance between the clamping surfaces of knuckles (60) and retaining surface (38); intermediate clamping surfaces (62) define a larger second maximum gap distance relative to retaining surface (38); and fingers (64, 66) define an even larger third maximum gap distance between the clamping surfaces of fingers (64, 66) and retaining surface (38). Accordingly, as shown in FIGS. 3A-3D, knuckles (60) are suited to receive and clamp a cylindrical element (70, 76) having a relatively smaller outer diameter, such as a cigarette or thin cigar (or "cigarillo"); intermediate clamping surfaces (62) are suited to receive and clamp a cylindrical element (72) of intermediate diameter, such as a medium size cigar; and fingers (64, 66) are suited to receive and clamp a cylindrical element (74, 78) having a relatively larger outer diameter, such as a large size cigar. As seen in FIG. 3C, the distal tips of knuckles (60), which define the proximal ends of intermediate clamping surfaces (62), may cooperate with fingers (64, 66) to capture and clamp larger cylindrical elements (72, 74) against retaining surface (38).

In the present example, knuckles (60) are configured to clamp cylindrical elements (70) having outer diameters as small as approximately 18/64 inches (or 18 ring gauge), and fingers (64, 66) are configured to clamp cylindrical elements (72, 74) having outer diameters as large as approximately 78/64 inches (or 78 ring gauge). Intermediate clamping surfaces (62) may be configured to clamp cylindrical elements (72) of any suitable outer diameter range falling within the minimum and maximum outer diameters that can be clamped by knuckles (60) and fingers (64, 66), respectively. It will be appreciated that these are merely exemplary sizes and that in other versions knuckles (60) and fingers (64, 66) may be suitably configured to clamp cylindrical elements (70, 72, 74) of various other diameters.

In some instances, device (10) may be employed to clamp multiple cylindrical elements simultaneously with two or more of clamping portions (60, 62, 64, 66) described above. FIG. 3D shows an exemplary use of device (10) in which knuckles (60) clamp a first cylindrical element (76) of smaller diameter, such as a cigarette or small cigar, and fingers (64, 66) simultaneously and independently clamp a second cylindrical element (78) of larger diameter, such as a large cigar. Though not shown, it will be appreciated that in other exemplary applications, knuckles (60) may clamp a first cylindrical element while intermediate clamping surfaces (62) simultaneously clamp a second cylindrical element; intermediate clamping surfaces (62) may clamp a first cylindrical element while fingers (64, 66) clamp a second cylindrical element; or all three clamping portions (60, 62, 64, 66) may clamp respective cylindrical elements simultaneously.

As also shown in FIGS. 3A-3D, clamp arm (14) is configured to orient a clamped cylindrical element (70, 72, 74, 76, 78) along a lateral axis that extends parallel to the clamp arm pivot axis defined by pivot pin (56), such that cylindrical element (70, 72, 74, 76, 78) may be supported horizontally when stem (16) is inserted vertically or horizontally into a support structure (e.g., a ground surface). In applications in which cylindrical element (70, 72, 74, 76, 78) is in the form of a lit cigar, cigarette, or other tobacco product, supporting the tobacco product horizontally provides the benefit of preventing either end of the tobacco product from contacting the support structure, which might otherwise contaminate or compromise the tobacco product. As described above, shelf (30) is configured to orient elongate elements (36) (e.g., golf tees) along respective axes that extend generally parallel to longitudinal axis of base (12), such that elongate elements (36) are supported transversely relative to the cylindrical element (70, 72, 74, 76, 78). Such a configuration may provide a user easy access to elongate elements (36) and cylindrical element (70, 72, 74, 76, 78) simultaneously during use of device (10). It will be appreciated, however, that in other examples shelf (30) may be alternatively configured and/or device (10) may include various additional or alternative features that orient one or more elongate elements (36) parallel or obliquely relative to a cylindrical element (70, 72, 74, 76, 78) clamped by clamp arm (14).

II. Exemplary Combinations

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

Example 1

A device for holding a cylindrical element, comprising: (a) a base; (b) a clamp arm coupled with the base, wherein the clamp arm is configured to pivot relative to the base between an open position and a closed position for clamping a cylindrical element against the base, wherein the clamp arm is resiliently biased toward the closed position; (c) a support feature coupled with the base, wherein the support feature is configured to releasably retain an elongate element while the clamp arm clamps the cylindrical element; and (d) a stem extending away from the base.

Example 2

The device of Example 1, wherein the clamp arm includes an arcuate clamping portion.

Example 3

The device of Example 2, wherein the arcuate clamping portion includes a plurality of fingers having free ends that are spaced apart from one another.

Example 4

The device of any of the preceding Examples, wherein the clamp arm includes: (i) a first clamping portion configured to clamp a first cylindrical element having a first maximum diameter against the base, and (ii) a second clamping portion configured to independently clamp a second cylindrical element having a second maximum diameter against the base, wherein the second maximum diameter is greater than the first maximum diameter.

Example 5

The device of any of Example 4, wherein when the clamp arm is in the open position the first clamping portion is configured to define a first maximum gap distance from the base and the second clamping portion is configured to define a second maximum gap distance from the base, wherein the second maximum gap distance is greater than the first maximum gap distance.

Example 6

The device of any of Examples 4 through 5, wherein the clamp arm includes a knuckle and a finger extending away from the knuckle, wherein the knuckle defines the first clamping portion, wherein the finger defines the second clamping portion.

Example 7

The device of any of Examples 4 through 6, wherein the clamp arm is configured to pivot about a pivot axis, wherein the first clamping portion is positioned closer to the pivot axis than the second clamping portion.

Example 8

The device of any of the preceding Examples, wherein an underside of the clamp arm includes a projection that extends toward the base, wherein the projection is configured to promote frictional engagement of the clamp arm with the cylindrical element.

Example 9

The device of any of the preceding Examples, wherein the base includes a textured surface configured to promote frictional engagement with the cylindrical element, wherein the clamp arm is configured to clamp the cylindrical element against the textured surface.

Example 10

The device of any of the preceding Examples, wherein the clamp arm is configured to orient the cylindrical element along a first axis, wherein the support feature is configured to orient the elongate element along a second axis transverse to the first axis.

Example 11

The device of any of the preceding Examples, wherein the support feature is rigidly coupled with the base.

Example 12

The device of any of the preceding Examples, wherein the support feature includes at least one opening configured to receive a portion of the elongate element.

Example 13

The device of any of the preceding Examples, wherein the support feature includes a plurality of openings, wherein each of the openings is configured to receive a portion of a respective elongate element.

Example 14

The device of any of the preceding Examples, wherein the cylindrical element comprises a tobacco product.

Example 15

The device of any of the preceding Examples, wherein the elongate element comprises a golf tee.

Example 16

A device for holding a cylindrical element, comprising: (a) a base; (b) a clamp arm coupled with a first portion of the base, wherein the clamp arm is configured to pivot relative to the base between an open position and a closed position for clamping a cylindrical element against the base; and (c) a support feature coupled with a second portion of the base, wherein the support feature provides an opening configured to releasably retain a golf tee.

Example 17

The device of Example 16, wherein the support feature is rigidly coupled with the base.

Example 18

The device of any of Examples 16 through 17, wherein the clamp arm is configured to orient the cylindrical element along a first axis, wherein the support feature is configured to orient the golf tee along a second axis transverse to the first axis.

Example 19

A device for holding a cylindrical element, comprising: (a) a base having a first base end and a second base end; (b) a clamp arm coupled with the base at a location between the first base end and the second base end, wherein the clamp arm is configured to pivot relative to the base between an open position and a closed position for clamping a cylindrical element against the base; (c) a support feature arranged at the first base end, wherein the support feature is configured to support an elongate element while the clamp arm clamps the cylindrical element; and (d) a stem arranged at the second base end, wherein the stem extends away from the second base and is configured to pierce a ground surface.

Example 20

The device of Example 19, wherein the clamp arm includes: (i) a first clamping portion configured to clamp a first cylindrical element having a first maximum diameter against the base, and (ii) a second clamping portion configured to independently clamp a second cylindrical element having a second maximum diameter against the base, wherein the second maximum diameter is greater than the first maximum diameter.

III. Miscellaneous

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. A device for holding a cylindrical element, comprising:

(a) a base having a first base end, a second base end, and a textured surface located between the first and second base ends;

(b) a clamp arm pivotably coupled with the base at a location between the first base end and the second base end, wherein the clamp arm includes:

(i) an actuatable portion having a free end, (ii) a first clamping portion extending from the actuatable portion, and (iii) a second clamping portion extending between the first clamping portion and the second base end, wherein the clamp arm is configured to pivot relative to the base from a closed position to an open position in response to actuation of the actuatable portion toward the first base end, wherein the free end of the actuatable portion is configured to overlie and extend away from the first base end in each of the closed and open positions, wherein in the closed position the first clamping portion is configured to clamp a first cylindrical element against the textured retaining surface and the second clamping portion is configured to clamp a second cylindrical element against the textured retaining surface such that the second clamping portion overlies the second base end, wherein the clamp arm in the open position is configured to release the first and second cylindrical elements from the textured retaining surface of the base, wherein the clamp arm is biased toward the closed position;

(c) a support feature arranged at the first base end, wherein the support feature includes a plurality of openings each configured to receive and releasably retain an elongate element while the clamp arm clamps at least one of the first or second cylindrical elements against the base such that the elongate element is supported above the at least one of the first or second cylindrical elements; and (d) a stem arranged at the second base end, wherein the stem extends away from the base and includes a pointed tip configured to pierce a ground surface.

2. The device of claim 1, wherein the second clamping portion is arcuate.

3. The device of claim 2, wherein the second clamping portion includes a plurality of fingers having free ends that are spaced apart from one another.

4. The device of claim 1, wherein the first cylindrical element has a first maximum diameter and the second cylindrical element has a second maximum diameter that is greater than the first maximum diameter.

5. The device of claim 1, wherein when the clamp arm is in the open position the first clamping portion is configured to define a first maximum gap distance from the textured retaining surface of the base and the second clamping portion is configured to define a second maximum gap distance from the textured retaining surface of the base, wherein the second maximum gap distance is greater than the first maximum gap distance.

6. The device of claim 1, wherein the clamp arm includes a knuckle and a finger extending away from the knuckle, wherein the knuckle defines the first clamping portion, wherein the finger defines the second clamping portion.

7. The device of claim 1, further comprising a pin, wherein the clamp arm is configured to pivot about a pivot axis defined by the pin, wherein the first clamping portion is positioned closer to the pivot axis than the second clamping portion.

8. The device of claim 1, wherein an underside of the clamp arm that faces the base includes a projection that extends toward the base.

9. The device of claim 1, wherein the clamp arm is configured to orient the first and second cylindrical elements in a first direction, wherein the support feature is configured to orient the elongate element in a second direction transverse to the first direction.

10. The device of claim 1, wherein the support feature is rigidly coupled with the base.

11. The device of claim 1, wherein the support feature includes a shelf, wherein the openings extend through a top surface of the shelf.

12. The device of claim 1, wherein each of the first and second cylindrical elements comprises a tobacco product.

13. The device of claim 1, wherein the elongate element comprises a golf tee.

14. The device of claim 1, further comprising a resilient member configured to resiliently bias the clamp arm toward the closed position, wherein the resilient member is non-integrally coupled with the base and the clamp arm.

15. The device of claim 14, wherein the resilient member comprises a torsion spring.

16. The device of claim 1, wherein the clamp arm is pivotable relative to the base about a pivot axis that is offset from the textured retaining surface.

17. The device of claim 1, wherein the second clamping portion of the clamp arm curves toward the base, wherein the actuatable portion of the clamp arm curves away from the base.

18. The device of claim 1, wherein the clamp arm is configured to clamp the first and second cylindrical elements against the base such that a central axis of the second cylindrical element is further away from the textured retaining surface than a central axis of the first cylindrical element.

19. The device of claim 1, wherein the base and the stem extend longitudinally along a common plane.

20. The device of claim 5, wherein the clamp arm further includes a third clamping portion disposed between the first and second clamping portions, wherein when the clamp arm is in the open position the first clamping portion is configured to define a third maximum gap distance from the textured retaining surface that is greater than the first maximum gap distance and less than the second maximum gap distance, wherein when the clamp arm is in the closed position the third clamping portion is configured to clamp a third cylindrical element against the textured retaining surface.

* * * * *